United States Patent [19]

Maynard

[11] Patent Number: 4,979,736

[45] Date of Patent: Dec. 25, 1990

[54] HYDRAULIC GYMNASIUM EQUIPMENT

[75] Inventor: Alan W. Maynard, Blair Athol, Australia

[73] Assignee: Titan Fitness Products Pty. Ltd., Blair Athol, Australia

[21] Appl. No.: 327,110

[22] Filed: Mar. 22, 1989

[30] Foreign Application Priority Data

Mar. 22, 1988 [AU] Australia ..... PI7367

[51] Int. Cl.[5] ..... A63B 21/008

[52] U.S. Cl. ..... 272/130; 272/134; 272/143; 272/DIG. 4

[58] Field of Search ..... 272/72, 73, 130, 134, 272/143, DIG. 4

[56] References Cited

U.S. PATENT DOCUMENTS

| | | | |
|---|---|---|---|
| 2,855,199 | 10/1958 | Noland et al. | 272/134 X |
| 3,128,094 | 4/1964 | Wolf | 272/130 |
| 3,495,824 | 2/1970 | Coinier | 272/130 |
| 3,822,599 | 7/1974 | Brentham | 272/130 X |
| 4,185,818 | 1/1980 | Brentham | 272/130 |
| 4,291,787 | 9/1981 | Brentham . | |
| 4,441,708 | 4/1984 | Brentham | 272/130 |
| 4,448,412 | 5/1984 | Brentham | 272/130 |
| 4,566,692 | 1/1986 | Brentham | 272/130 |
| 4,667,955 | 5/1987 | Giesch | 272/130 |

FOREIGN PATENT DOCUMENTS

| | | | |
|---|---|---|---|
| 1153143 | 5/1969 | United Kingdom | 272/130 |
| 8400496 | 2/1984 | World Int. Prop. O. | 272/72 |

*Primary Examiner*—Robert Bahr

*Attorney, Agent, or Firm*—Darby & Darby

[57] ABSTRACT

Gymnasium equipment has a vertically movable column on the upper end of which are a pair of arm retention tubes which will accept arms of various items of ancillary equipment to perform a range of gymnasium functions. A gymnast will cause the ancillary equipment, and therefore the retention tubes, to rock about in horizontal axis, and in doing so cause a piston to move in or out of an hydraulic cylinder, displacing oil from the cylinder through a valve at a rate which is adjustable. With simple and inexpensive ancillary equipment, the invention makes it possible to achieve many different gymnastic functions.

8 Claims, 1 Drawing Sheet

HYDRAULIC GYMNASIUM EQUIPMENT

This invention relates to an article of gymnasium equipment which has an hydraulic operator and which can be used for any one of a number of different functions.

BACKGROUND OF THE INVENTION

One of the difficulties which is encountered with gymnasium equipment is that many pieces of equipment are required to achieve the required number of functions, and gymnasium requires a wide range of functions in order to be fully effective. The main object of this invention is to provide a device which, with minor ancillary equipment, is useful for assisting a gymnast to perform any one of a range of functions, and yet the device to be so simple that its cost can be relatively small.

BRIEF SUMMARY OF THE INVENTION

In an embodiment of this invention, gymnasium equipment has a vertically movable column on the upper end of which are a pair of arm retention tubes which will accept arms of various items of ancillary equipment to perform a range of gymnasium functions. A gymnast will cause the ancillary equipment, and therefore the retention tubes, to rock about in horizontal axis, and in doing so cause a piston to move in or out of an hydraulic cylinder, displacing oil from the cylinder through a valve at a rate which is adjustable.

The arm retention means can be any one of a number of means but in an embodiment of the invention comprises a pair of tubular sockets which are angled with respect to one another.

BRIEF DESCRIPTION OF THE DRAWINGS

An embodiment of the invention is described hereunder in some detail, with reference to, and is illustrated in, the accompanying drawings, in which.

Figure 1:
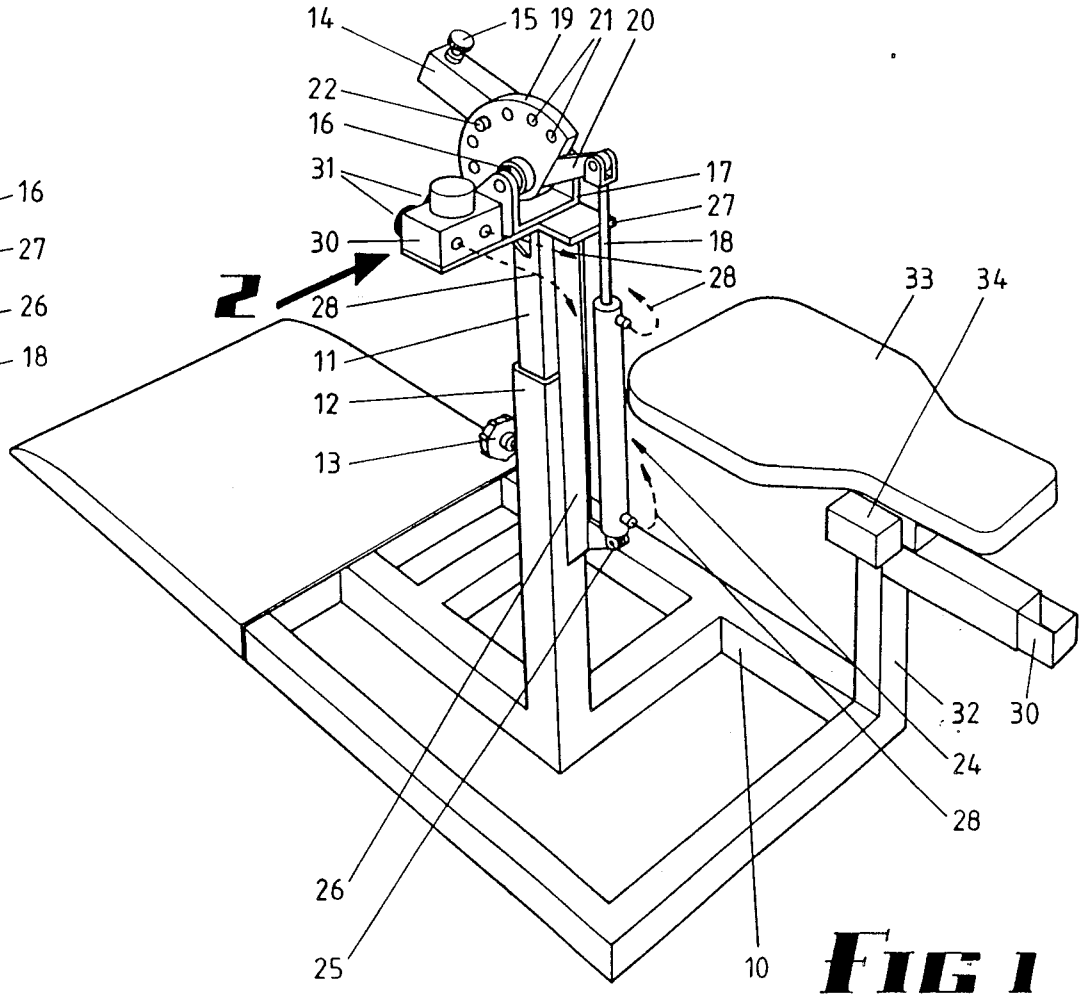
FIG. 1 is a perspective view showing the gymnasium equipment.
Figure 2:
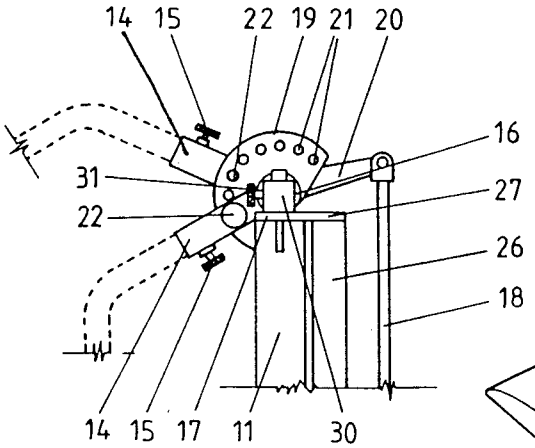
FIG. 2 is a fragmentary side elevation taken in the direction of the arrow 2, and showing more particularly the arm retention means at the top of the vertically movable column.

In this embodiment, gymnasium equipment comprises a base frame 10 which is provided with a vertically movable column 11 which is guided in its vertical movement by the inner surfaces of the walls of a square guide tube 12, while a screw threaded handle 13 is arranged to clamp the column in any selected position against an inner surface of tube 12. Different positions are required for different exercises.

The upper end of the vertically movable column 11 is provided with two square section tubes or arm retention tubes 14 which project at an angle with respect to one another, and each carries a respective locking handle and screw 15 so that a further piece of equipment (shown in dotted lines) can be temporarily retained in either one of the arm retention tubes 14. Both the tubes 14 are carried on a single horizontal hinge bar 16 which is carried by a bracket 17 on the upper end of column 11, and pivotal movement of a part circular plate 19 about the cylindrical axis of hinge bar 16 actuates the piston rod 18 which is trunnion mounted to a projecting portion 20 of plate 19, the part circular portion 19 having a plurality of apertures 21 on a pitch circle. Each tube 14 provided with a respective spring loaded plunger 22 by which its angular relationship with plate 19 can be adjusted.

The piston rod 18 is the piston rod of a cylindrical/-piston assembly 24, the cylinder of which is also trunnion mounted but onto a bracket 25 which is outstanding from a lower portion of an outer downward extension 26 of the vertically movable column 11, which is coupled to the upper end of column 11 by a gussetted plate 27 (which supports the bracket 17), but extension 26 extends downwardly to lie alongside (but spaced from) guide tube 12.

The equipment, when in use, has a projecting arm (or arms) of ancillary equipment selectively secured in one (or both) the tubes 14 by locking screws 15, and projects therefrom. By applying an appropriate force to that ancillary equipment, the plate 19 is caused to rock about hinge bar 16, causing the piston rod 18 to move in or out in the cylinder/piston assembly 24.

The bracket 17 may carry on it an adjustable two-way valve 30 which has on it adjustment screws 31 which in turn adjust the rate of flow of fluid displaced by the piston of the piston/cylinder assembly 24 through conduits 28 (shown dotted), so that the resistance to movement can be readily adjusted. The valve 30 is generally in accordance with our co-pending Australian Patent Application No. 13109/88. The plate 27 can alternatively carry a semi-rotary pump (in lieu of cylinder/piston assembly 24), for displacement of hydraulic fluid through valve 30.

The base frame 10 is also provided with an upstanding seat post 32 at one corner which supports a seat 33, the seat post 32 also carrying on it tubular sockets 34 which are capable of supporting further items of gymnasium equipment.

With this arrangement, the equipment is able to be readily changed to another mode of use where the cylinder is required to be removed and replaced, e.g. by a rotary pump.

The invention will be seen to be extremely simple, but results in a large number of possible function usages, as listed below:

EXERCISES

Single overhead press, left and right.
Single overhead pulldown left and right.

Double overhead press (pronated and supinated grips).

Double overhead pulldown.

Upright row, low and high*.
*Re Upright Row above. Note that a lift to the chin area predominately invokes: Forearms Biceps Anterior (front) shoulder.

Tricep pushdown.

Single overhead press behind neck.
Single pulldown behind neck.

Double overhead press behind neck.
Double pulldown behind neck.

Sidebends.

Ab curl.
Back extension.

Sidebends,
Double calf raise.
Single calf raise.

Shrugs.

Upright Row, low and high*.
*Re Upright Row above. Note that a lift to the chin area predominately invokes: Forearms Biceps Anterior (front) shoulder.

Tricep pushdown.

Bicep curl.
Tricep extension.

Reverse grip bicep curl.
Reverse grip tricep extension.

Bentover row.
Bentover pushdown.

Ab curl.
Back extension.

Hip flexion.
Hip extension.

Hip abduction (Note-set roller height to knee level or position of maximum comfort).

Double bench press.
Double supine row.
Single bench press.
Single supine row.
(Pronated and supinated grips.)

Double knee extension.
Double knee flexion.

Single knee extension.
Single knee flexion.

By elevating to forehead area, the trapezuis is invoked much more.

The amount of additional equipment for these functions is very small and the cost is also very small, and for little extra cost the equipment of this invention is capable of replacing a number of items of equipment of much higher cost which exists in the prior art.

I claim:

1. Gymnasium equipment comprising a base frame, a guide upstanding from the base frame, a vertically movable column carried by the guide for relative vertical movement, a hinge having a horizontal pivotal axis on the upper end of the column, retention means carried on the hinge and constructed to support ancillary equipment, a hydraulic pump operatively located between the retention means and the movable column such that pivotal movement of the retention means about said axis causes actuation of the hydraulic pump, a valve having flow rate adjustment means, for adjusting resistance to movement of hydraulic oil in a circuit comprising the hydraulic pump, the valve and conduits which extends between the hydraulic pump and the valve, said hydraulic pump being actuatable by said pivotal movement of said retention means to displace hydraulic fluid through said valve via said conduits, said retention means including a pair of retention tubes and means for adjusting an angular relationship of each of said retention tubes independently with respect to said hinge.

2. Gymnasium equipment according to claim 1 wherein said hydraulic pump comprises a piston/cylinder combination.

3. Gymnasium equipment according to claim 1 wherein said hydraulic pump is a semi-rotary pump.

4. Gymnasium equipment according to claim 1 wherein said guide and said vertically movable column are both rectangular section tubes, wherein outer surfaces of the column slidably engage inner surface of the guide tube, and said guide tube is threadably engaged by a screw threaded handle which is operable to clamp said vertically movable column against a said inner surface of said guide tube.

5. Gymnasium equipment according to claim 1, wherein said hinge comprises a hinge bar wherein said horizontal pivotal axis is a cylindrical axis of said hinge bar, and said retention means comprises two tubular sockets which are not at an angle with respect to one another, and which pivot about the cylindrical axis of the hinge bar, each tubular socket containing a locking screw by which ancillary equipment can be clamped within that socket.

6. Gymnasium equipment according to claim 5, wherein said hydraulic pump comprises a piston cylinder combination, said vertically movable column including a downward extension which lies alongside the guide, further comprising a plate pivotable about the cylindrical axis of the hinge bar, the plate having a projecting portion and a plurality of apertures extending through the plate and spaced around a pitch circle, said piston cylinder combination being trunnion mounted between said projecting portion and said downward portion, said retention means including retention tubes each with a spring loaded plunger engageable in a selectable one of said plate apertures for adjusting an angular relationship of each retention tube with the plate.

7. Gynmnasium equipment according to claim 1 further comprising a seat post upstanding from the base and having a seat thereon adjustable for position.

8. Gymnasium equipment comprising a base frame, a guide upstanding from the base frame, a vertically movable column carried by the guide for relative vertical movement, a hinge having a horizontal pivotal axis on the upper end of the column, retention means carried on the hinge and constructed to support ancillary equipment, hydraulic pump means operatively located between the retention means and the movable column such that pivotal movement of the retention means about said axis causes actuation of the hydraulic pump means, a valve having flow rate adjustment means, and conduits extending from the hydraulic pump means to the valve, said hydraulic means being actuatable by said pivotal movement of said retention means to displace hydraulic fluid through said valve via said conduits, a plate pivotable about the horizontal pivotal axis, said plate having a plurality of apertures which extend through said plate and spaced around a pitch circle, said retention means including retention tubes each with a plunger engageable into a selectable one of said apertures of said plate for adjusting an angular relationship of each retention tube with the plate.

* * * * *

UNITED STATES PATENT AND TRADEMARK OFFICE

CERTIFICATE OF CORRECTION

PATENT NO. : 4,979,736

DATED : December 25, 1990

INVENTOR(S) : Alan William Maynard

It is certified that error appears in the above-identified patent and that said Letters Patent is hereby corrected as shown below:

Col. 3 line 61, cancel "flow rate" and ",";

Col. 3 line 63, change "extends" to --extend--.

Signed and Sealed this

Ninth Day of June, 1992

*Attest:*

DOUGLAS B. COMER

*Attesting Officer*

*Acting Commissioner of Patents and Trademarks*